US007493946B2

(12) United States Patent
Filippov et al.

(10) Patent No.: US 7,493,946 B2
(45) Date of Patent: Feb. 24, 2009

(54) APPARATUS FOR RADIAL EXPANSION OF A TUBULAR

(75) Inventors: Andrei Gregory Filippov, Houston, TX (US); Scott Anthony Benzie, Houston, TX (US); Dimitri Andrei Filippov, Houston, TX (US)

(73) Assignee: Mohawk Energy Ltd., Houston, TX (US)

( * ) Notice: Subject to any disclaimer, the term of this patent is extended or adjusted under 35 U.S.C. 154(b) by 0 days.

(21) Appl. No.: 11/734,167

(22) Filed: Apr. 11, 2007

(65) Prior Publication Data

US 2007/0240878 A1 Oct. 18, 2007

Related U.S. Application Data

(60) Provisional application No. 60/791,081, filed on Apr. 12, 2006.

(51) Int. Cl.
*E21B 23/00* (2006.01)

(52) U.S. Cl. ..... 166/216; 166/207; 166/212

(58) Field of Classification Search ..... 166/277, 166/380, 382, 383, 119, 181, 187, 207, 212, 166/213, 216, 217, 55; 29/522.1, 523; 72/370.01, 72/370.06, 58
See application file for complete search history.

(56) References Cited

U.S. PATENT DOCUMENTS

| | | | | |
|---|---|---|---|---|
| 2,350,973 | A * | 6/1944 | Brumleu et al. | 166/106 |
| 3,191,668 | A | 6/1965 | Lorenz | |
| 3,191,680 | A | 6/1965 | Vincent | |
| 3,203,451 | A | 8/1965 | Vincent | |
| 4,678,035 | A * | 7/1987 | Goldschild | 166/250.07 |
| 5,348,095 | A | 9/1994 | Worrall et al. | |
| 6,085,838 | A | 7/2000 | Vercaemer et al. | |
| 6,631,759 | B2 | 10/2003 | Cook et al. | |
| 6,631,769 | B2 | 10/2003 | Cooke et al. | |
| 6,640,903 | B1 | 11/2003 | Cook et al. | |
| 6,695,012 | B1 | 2/2004 | Ring et al. | |
| 6,892,819 | B2 | 5/2005 | Cook et al. | |
| 7,172,019 | B2 | 2/2007 | Cook et al. | |
| 7,185,701 | B2 | 3/2007 | Mackenzie | |
| 2004/0040721 | A1 * | 3/2004 | Maguire et al. | 166/380 |
| 2004/0112589 | A1 * | 6/2004 | Cook et al. | 166/207 |
| 2004/0149442 | A1 * | 8/2004 | Mackenzie | 166/297 |

FOREIGN PATENT DOCUMENTS

WO WO2004/099561 11/2004

OTHER PUBLICATIONS

Office Action for U.S. Appl. No. 11/691,375, filed Aug. 4, 2008.

* cited by examiner

*Primary Examiner*—Jennifer H Gay
*Assistant Examiner*—David Andrews
(74) *Attorney, Agent, or Firm*—Tod T. Tumey

(57) ABSTRACT

A method and apparatus expand tubulars with a tubular expansion apparatus. In an embodiment, a tubular expansion apparatus includes an expansion swage. In addition, the tubular expansion apparatus includes an actuator. Moreover, the tubular expansion apparatus includes at least two anchors. The tubular expansion apparatus further includes at least one anchor longitudinally moveable relative to the other anchor while both anchors are engaged with the inner diameter of the tubular.

7 Claims, 1 Drawing Sheet

APPARATUS FOR RADIAL EXPANSION OF A TUBULAR

CROSS-REFERENCE TO RELATED APPLICATIONS

This application is a non-provisional application that claims the benefit of U.S. Application Ser. No. 60/791,081 filed on Apr. 12, 2006, which is incorporated by reference herein in its entirety.

STATEMENT REGARDING FEDERALLY SPONSORED RESEARCH OR DEVELOPMENT

Not applicable.

BACKGROUND OF THE INVENTION

1. Field of the Invention

This invention relates to the field of expandable tubulars and more specifically to a tubular expansion apparatus having one anchor longitudinally moveable relative to another anchor.

2. Background of the Invention

In conventional drilling operations, it may be desirable to insert a tubular in a wellbore and expand the tubular downhole to make a casing repair, or in other applications to isolate an unconsolidated portion of a formation that is being drilled by expanding the tubular against the formation.

Various techniques to accomplish such tubular expansion have been attempted in the past. In one technique, an apparatus utilizing a casing packer as an anchor in combination with an expansion swage and a hydraulic cylinder allows radial expansion of long sections of the tubular. A drawback to such a technique having an apparatus with a single anchor positioned in the front of the swage is that the technique may not provide sufficient reaction force for the exit of the swage from the tubular at the end of the expansion process, which may result in the expansion process not being completed. Another conventional technique utilizes two anchors with one anchor in the front and the other anchor in the back of the swage. A drawback to this technique is that two anchors in such configuration may not allow for longitudinal shrinkage of the tubular upon its radial expansion, which may result in high longitudinal stresses and excessive wall thinning of the expanded tubular and may decrease burst and collapse resistance of the tubular.

Consequently, there is a need for an apparatus and technique for reliable and complete radial expansion of a tubular, which may allow for improved performance characteristics of the tubular compared to tubulars expanded by conventional techniques.

BRIEF SUMMARY OF SOME OF THE PREFERRED EMBODIMENTS

These and other needs in the art are addressed in one embodiment by a tubular expansion apparatus. The tubular expansion apparatus includes an expansion swage. In addition, the tubular expansion apparatus includes an actuator. Moreover, the tubular expansion apparatus includes at least two anchors. The tubular expansion apparatus farther includes at least one anchor longitudinally moveable relative to the other anchor while both anchors are engaged with the inner diameter of the tubular.

In another embodiment, these and other needs in the art are addressed by an anchoring device. The anchoring device includes an anchor slidably positioned on a shaft. In addition, the anchoring device includes two stoppers with one stopper positioned axially on one side of the anchor and the other stopper positioned axially on the other side of the anchor.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other embodiments for carrying out the same purposes of the present invention. It should also be realized by those skilled in the art that such equivalent embodiments do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

NOTATION AND NOMENCLATURE

Figure 1A:
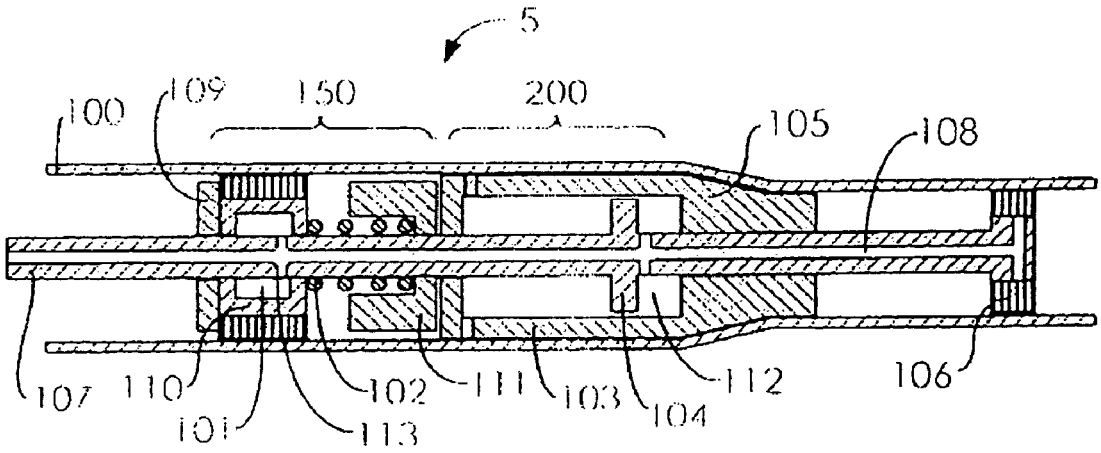
FIG. 1A illustrates a fragmentary cross-sectional view of a tubular expansion apparatus in its reset position.

Certain terms are used throughout the following description and claims to refer to particular components. This document does not intend to distinguish between components that differ in name but not function.

"Actuator" refers to a device comprising one or more annular pistons and a cylinder slidingly arranged over the pistons, having at least one pressure chamber per piston, and capable of providing a sufficient force to axially move the expansion swage inside the expandable tubular to plastically radially expand the tubular.

"Anchor" refers to a device capable of selective engagement with the inner surface of the tubular and preventing movement of selected parts of the tubular expansion apparatus relative to the tubular.

"Expandable tubular" or "tubular" refers to a member such as a liner, casing, borehole clad to seal a selected zone, or the like that is capable of being plastically radially expanded.

"Expansion swage" refers to a device capable of plastically increasing tubular diameter when it is displaced in the longitudinal direction of the tubular. For instance, an expansion swage includes a tapered cone of a fixed or variable diameter.

"Length of expansion stroke" refers to the maximum displacement of the expansion swage under a single action of the actuator.

"Stopper" refers to a device capable of transmitting a load from the anchor to selected parts of the tubular expansion apparatus.

DETAILED DESCRIPTION OF THE PREFERRED EMBODIMENTS

Without being limited by theory, it has been established that during plastic deformation of metals, the volume of the material may not change and remains constant. Thus, during radial expansion, the stretching of the tubular in the hoop direction may be compensated by shrinkage in the longitudinal direction and by shrinkage in the radial direction (e.g., wall thickness). If, both front and back anchors are engaged with the tubular and do not allow for its longitudinal shrinkage, then the wall shrinkage may be equal to the degree of the radial expansion. It is to be understood that the performance characteristics of the expanded tubular, such as burst and collapse resistance, directly relate to the tubular wall thickness. In an embodiment, a tubular expansion apparatus includes a two anchor expansion system that provides for exit of an expansion swage from the tubular at the end of the expansion process and maximizes the performance characteristics of the expanded tubular.

In an embodiment, the tubular expansion apparatus provides for radial expansion of a tubular. The tubular expansion apparatus includes two anchors with at least one anchor axially movable relative to the other anchor while both anchors are engaged with the inner diameter of the tubular, an expansion swage, and an actuator capable of providing a suitable force for axial movement of the expansion swage inside the expandable tubular to plastically radially expand the tubular. In an embodiment, the tubular expansion apparatus includes an anchoring device. The anchoring device includes at least one anchor capable of axial displacement relative to the other anchor while both anchors are engaged with the inner diameter of the tubular. In an embodiment, two stoppers are positioned on each side of the at least one anchor, and a spring is positioned between one of the stoppers and the at least one anchor. In embodiments, one of the anchors is positioned in front of the expansion swage and the other anchor in back of the expansion swage, which may allow the expansion swage to be positioned outside the tubular before expansion and may also allow for the exit of the expansion swage out of the tubular at the end of the expansion process. The length of axial movement of the at least one anchor between stoppers is selected to allow for longitudinal shrinkage of the tubular during its radial expansion, which may result in improved performance of the expanded tubular.

FIG. 1A shows a schematic cross-section of tubular expansion apparatus 5 for radial expansion of tubular 100. Tubular expansion apparatus 5 includes shaft 107, anchoring device 150, anchor 106, actuator 200, and expansion swage 105. Shaft 107 has bore 108 for supplying operational fluid to pressure chamber 112 of actuator 200 and to anchors 106 (front anchor) and 110 (back anchor). In use, pressurized operating fluid is pumped through the drill string or coiled tubing into bore 108. Actuator 200 comprises propulsion cylinder 103 attached to expansion swage 105 and piston 104 attached to shaft 107. Propulsion cylinder 103 is longitudinally slidably engaged with shaft 107 and piston 104 and forms internal annular pressure chamber 112 surrounding shaft 107. Although one propulsion cylinder 103 and one corresponding piston 104 are shown in the illustrated embodiment, any number of cylinders and pistons may be provided. The hydraulic thrust provided by actuator 200 increases as the number of propulsion cylinders increases. The hydraulic force provided by the cylinders is additive, thus, the number of cylinders is selected according to the desired thrust.

As illustrated in FIG. 1A, anchor 106 is attached to shaft 107 and may be engaged with the inside surface of tubular 100, thereby preventing movement of shaft 107 relative to tubular 100 under applied forces, during the expansion process. Anchor 106 may be engaged or disengaged with tubular 100 by applying or releasing pressure in bore 108.

As further illustrated in FIG. 1A, anchoring device 150 includes anchor 110 longitudinally slidably attached to shaft 107. Anchor 110 comprises internal annular chamber 101 surrounding shaft 107 to provide a liquid communication between bore 108 and an anchoring engagement mechanism (not shown). Anchoring device 150 also includes two end position stoppers 109 (back stopper) and 111 (front stopper) attached to shaft 107. Spring 102 between anchor 110 and end position stopper 111 is capable of moving anchor 110 to end position stopper 109 when the pressure in internal annular chamber 101 is released. By applying or releasing pressure in internal annular chamber 101 through inlet passage 113, anchor 110 may be engaged or disengaged with the inside surface of tubular 100.

Figure 1B:
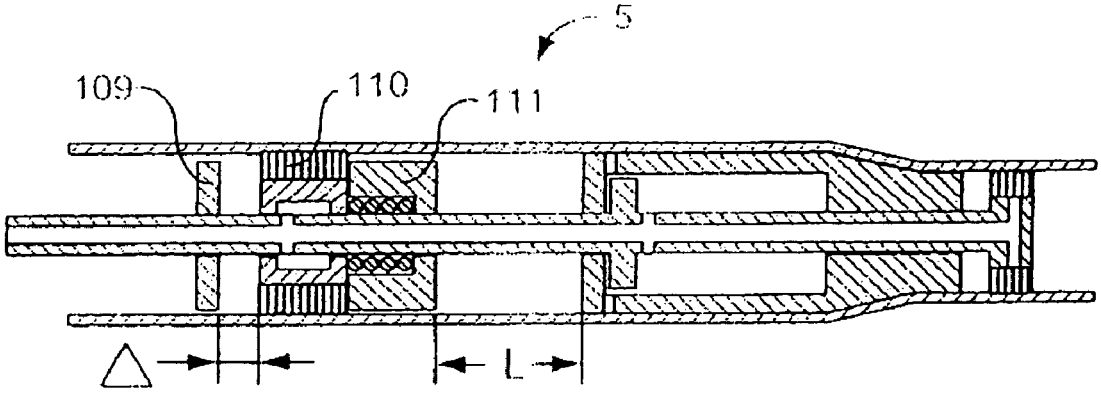
FIG. 1B illustrates a fragmentary cross-sectional view of the tubular expansion apparatus of FIG. 1A at the end of the power stroke.

The configuration of the expansion apparatus shown in FIG. 1A corresponds to its reset position. In operation, the pressure in bore 108 is released, both anchors 106 and 110 are disengaged, piston 104 is in a fully retracted position with regard to expansion swage 105, and anchor 110 is in a fully retracted position with regard to end position stopper 109. The power stroke is initiated by applying pressure through bore 108 to both anchors 106, 110 and in pressure chamber 112. Anchors 106, 110 become engaged with tubular 100, and expansion swage 105 begins moving inside tubular 100 and expanding tubular 100. The expansion force generated by pressure in pressure chamber 112 is acting against the reaction force generated by anchor 106. Anchor 110 may slide forward and, therefore, allows for longitudinal shrinkage of tubular 100. At the end of the power stroke, as illustrated in FIG. 1B, a certain length L of tubular 100 has been expanded from the original inside diameter Do to the expanded inside diameter Dexp. The expansion ratio $\epsilon$ may be estimated as shown in Equation (1).

$$\varepsilon = \frac{(D\exp - Do)}{Do} \tag{1}$$

As further illustrated in FIG. 1B, the shrinkage of tubular 100 in the longitudinal direction due to its radial expansion, $\Delta$, may be estimated as two thirds of the degree of radial expansion of equation (1) times the length of the expanded portion of tubular 100 substantially equal to the length, L, of the expansion stroke of actuator 200 as shown in Equation (2).

$$\Delta = \frac{2}{3} \cdot L \cdot \varepsilon \tag{2}$$

Combining equations (1) and (2) yields equation (3).

$$\Delta = \frac{2}{3} \cdot L \cdot \frac{(D\exp - Do)}{Do} \tag{3}$$

Thus, the minimum distance for sliding of anchor 110 between end position stopper 111 and end position stopper 109 may not be less than that defined by equation (3).

For instance, in regards to a tubular expansion apparatus with an expansion stroke of actuator, L=5 ft, and expansion ratio of radial expansion $\epsilon$=25%, the minimum distance for sliding of anchor 110 is $\Delta$=10.5 in.

Figure 1C:
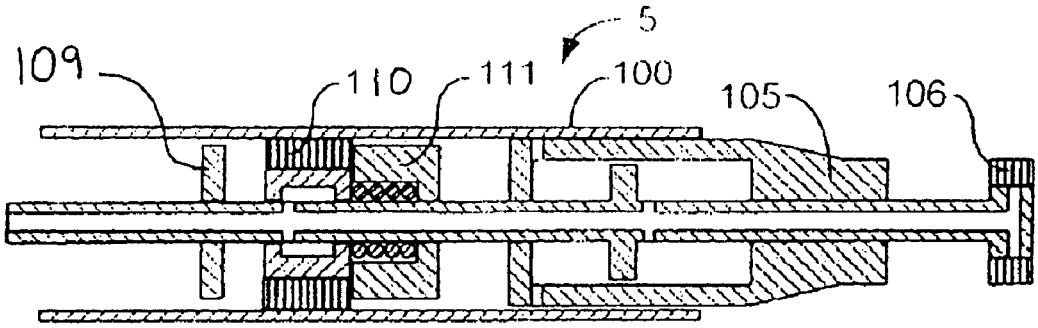
FIG. 1C illustrates a fragmentary cross-sectional view of the tubular expansion apparatus of FIG. 1A at the end of the expansion process.

As shown in FIG. 1C, at the end of the expansion process, anchor 106 exits tubular 100 and the last few expansion strokes are accomplished against the reaction force generated by anchor 110 engaged with the inside surface of tubular 100 and acting against end position stopper 111. Without being limited by theory, such result may always be achievable as according to Δ<L of equations (3).

It is to be understood that tubular expansion apparatus 5 may be used to expand either perforated or non-perforated tubulars or tubulars that include portions of both, since pressure automatically increases or decreases to provide the expansion forces.

It is to be further understood that tubular expansion apparatus 5 includes at least one anchor capable of a limited longitudinal displacement with regard to other anchors while all anchors are engaged with the inner diameter of tubular 100, but, in alternative embodiments, tubular expansion apparatus 5 may be employed in various different ways. For instance the anchors may be either hydraulically operated or mechanically operated one way anchors, with the anchor having a limited longitudinal displacement positioned either in the front or in the back of expansion swage 105.

Although the present invention and its advantages have been described in detail, it should be understood that various changes, substitutions and alterations may be made herein without departing from the spirit and scope of the invention as defined by the appended claims.

The invention claimed is:

1. An apparatus for expansion of a tubular, comprising:

an expansion swage;

an actuator; and at least two anchors, wherein at least one anchor is longitudinally moveable relative to the other anchor while both anchors are engaged with an inner diameter of the tubular, and wherein the at least one anchor is positioned between two stoppers, and wherein the stoppers are further positioned to limit longitudinal movement of the at least one anchor to between the stoppers;

wherein the two stoppers are positioned at a distance allowing axial displacement of the at least one anchor between the two stoppers, and wherein the axial displacement is Δ, and further wherein Δ is defined by $$\Delta = \left(\frac{2}{3}\right) \cdot L \cdot \frac{(D\exp - Do)}{Do}$$

wherein L is a length of an expansion stroke of the actuator, Dexp is inside diameter of the tubular after expansion, and Do is the inside diameter of the tubular before expansion.

2. The apparatus of claim 1, wherein Δ is a minimum distance for longitudinal movement of the at least one anchor between the two stoppers.

3. The apparatus of claim 1, wherein the other anchor is attached to a shaft, and wherein engagement of the other anchor with the inner diameter of the tubular prevents movement of the shaft relative to the tubular.

4. The apparatus of claim 3, wherein the shaft comprises a bore, and wherein the other anchor is engaged or disengaged with the inner diameter of the tubular by applying or releasing pressure in the bore.

5. The apparatus of claim 1, wherein the at least one anchor comprises an internal annular chamber surrounding a shaft.

6. The apparatus of claim 5, wherein the shaft comprises a bore, and wherein the internal annular chamber provides a liquid communication between the bore and an anchoring engagement mechanism.

7. An apparatus for expansion of a tubular, comprising:

an expansion swage;

an actuator;

at least two anchors, wherein at least one anchor is longitudinally moveable relative to the other anchor while both anchors are engaged with an inner diameter of the tubular, and wherein the at least one anchor is positioned between two stoppers, and wherein the stoppers are further positioned to limit longitudinal movement of the at least one anchor to between the stoppers, and further wherein the at least one anchor comprises an internal annular chamber surrounding a shaft; and a spring positioned between the at least one anchor and one of the stoppers, and wherein the spring moves the at least one anchor to a second of the stoppers when pressure in the internal annular chamber is released.

* * * * *